US010900693B2

(12) United States Patent
Choi

(10) Patent No.: US 10,900,693 B2
(45) Date of Patent: Jan. 26, 2021

(54) HOT WATER STORAGE BOILER HAVING SCALE PREVENTION FUNCTION

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 145 days.

(21) Appl. No.: 16/109,550

(22) Filed: Aug. 22, 2018

(65) Prior Publication Data

US 2019/0162444 A1 May 30, 2019

(30) Foreign Application Priority Data

Nov. 28, 2017 (KR) ..... 10-2017-0160313

(51) Int. Cl.

| | |
|---|---|
| ***F24H 9/00*** | (2006.01) |
| ***F24H 1/20*** | (2006.01) |
| ***F24H 9/14*** | (2006.01) |
| ***F24H 9/20*** | (2006.01) |

(52) U.S. Cl.

CPC ..... *F24H 9/0047* (2013.01); *F24H 1/205* (2013.01); *F24H 9/0042* (2013.01); *F24H 9/142* (2013.01); *F24H 9/2035* (2013.01)

(58) Field of Classification Search

CPC ..... F24H 9/0047; F24H 9/0042; F24H 9/142; F24H 9/2035; F24H 1/205

USPC ..... 122/14.3

See application file for complete search history.

(56) References Cited

U.S. PATENT DOCUMENTS 2,290,368 A * 7/1942 Dutton ..... F28G 3/166 122/405
4,271,789 A * 6/1981 Black ..... F23N 1/027 122/14.22
4,838,211 A * 6/1989 Vago ..... F24H 1/205 122/159

FOREIGN PATENT DOCUMENTS

WO WO-2016159709 A1 * 10/2016 ..... F24H 9/0031

* cited by examiner

*Primary Examiner* — Steven B McAllister
*Assistant Examiner* — Allen R Schult
(74) *Attorney, Agent, or Firm* — Studebaker & Brakett PC

(57) ABSTRACT

The present invention relates to a hot water storage boiler having a scale prevention function, the boiler being able to prevent scale without an additive or an ultrasonic device. Low-temperature water is sprayed toward the bottom portion of the combustion chamber using the spray pipe. This consequently lowers the temperature of the bottom portion of the combustion chamber, thereby reducing production of scale.

8 Claims, 7 Drawing Sheets

-- Related Art--

HOT WATER STORAGE BOILER HAVING SCALE PREVENTION FUNCTION

TECHNICAL FIELD

The present invention relates to a hot water storage boiler having a scale prevention function and, more particularly, to a hot water storage boiler having a scale prevention function, the boiler being able to prevent scale without an additive or an ultrasonic device.

BACKGROUND ART

In general, gas boilers are used for heating, by using gas as fuel and water as heat medium. In particular, hot water supply boilers cause heating water to circulate through the interior thereof using a three-way valve, and have a burner to heat water by indirect heat exchange, so that people can use hot water. Such gas boilers are categorized as instant heating boilers and hot water storage boilers. Unlike instant heating boilers operating a burner to provide hot water as required, hot water storage boilers store hot water separately in a hot water tank such that hot water can be promptly used as required.

FIG. 1 illustrates a hot water storage boiler of the related art. Referring to FIG. 1, the hot water storage boiler of the related art includes a heat-exchanging means 14 having a bundle of tubes 14*a* within a body 12, a burner unit 16 projecting a flame to the heat-exchanging means 14, an intake unit 18 supplying air to the burner unit 16, and an outlet unit 19 exhausting combustion gas produced by the burner unit 16. Water supplied from an external water supply is brought into contact with the bundle of tubes 14*a* within a housing of the body to be converted into hot water by heat exchange. Hot water produced in this manner is supplied to a hot water pipe (not shown) using a circulation pump (not shown) or the like.

Since heat exchange is undertaken with supply water being in contact with the bundle of tubes 14*a* or the burner unit 16, scale accumulated in the bundle of tubes 14*a* or the burner unit 16 may lower the heat exchange efficiency of the bundle of tubes 14*a* or the burner unit 16. Scale is caused by impurities contained in supply water, such as silica, calcium (Ca), or magnesium (Mg). Since the heat conductivity of such an impurity is significantly lower than the heat conductivity of a material of the bundle of tubes 14*a* or the burner unit 16, such as copper (Cu) or steel, scale formed of such impurities, when accumulated in the bundle of tubes 14*a* or the burner unit 16, may lower the heat exchange efficiency of the bundle of tubes 14*a* or the burner unit 16, which is problematic. In particular, since scale tends to be easily produced in a high-temperature environment, scale may be more easily produced on or around the burner unit 16.

Conventional methods for minimizing effects of scale may include a method of inputting an additive to reduce the reaction of scale, a method of removing scale, and the like. However, such methods require a consumable additive to be supplied repeatedly, an ultrasonic device to be added, or the piping of heat exchange equipment to be sophisticated, which is problematic.

In addition, there is another method of lowering the internal temperature of the burner unit 16 to reduce the production of scale. However, when the internal temperature of the burner unit 16 is lowered, the efficiency of heat exchange is also lowered, which is problematic.

DISCLOSURE

Technical Problem

Accordingly, the present invention has been made keeping in mind the above problems occurring in the prior art, and an object of the present invention is to provide a hot water storage boiler having a scale prevention function, the boiler being able to prevent scale without an additive or an ultrasonic device by lowering the surrounding temperature of a burner unit without changing the internal temperature of the burner unit.

Technical Solution

In order to accomplish the above object, the present invention provides a hot water storage boiler may include: a body having defined a space therein, to which water is supplied, the body including a combustion chamber provided in an upper portion of the space; a burner projecting a flame into the combustion chamber; a plurality of tubes located within the space, with top ends thereof being integrally connected to a bottom surface of the combustion chamber and bottom ends thereof extending to a bottom portion of the space; an exhaust unit provided on a bottom of the body and integrally connected to the bottom ends of the tubes; and a spray pipe disposed within the body to face the bottom surface of the combustion chamber, with a plurality of spray holes thereof being provided in a direction of the bottom surface of the combustion chamber. Water supplied to the spray pipe is sprayed through the plurality of spray holes toward the bottom surface of the combustion chamber.

In the hot water storage boiler, the spray pipe may include: a plurality of C-shaped concentric supply pipes having different radii; a connector pipe connecting ends of a pair of adjacent supply pipes among the plurality of supply pipes, except for one end of an outermost supply pipe and one end an innermost supply pipe among the plurality of supply pipes; and an inlet pipe connected to one end of the outermost supply pipe or the innermost supply pipe among the plurality of supply pipes. The plurality of spray holes may be provided in top portions of the supply pipes and the connector pipe along longitudinal directions thereof. Water entering through the inlet pipe may be supplied to the plurality of supply pipes and the connector pipe and then be sprayed through the plurality of spray holes toward the bottom surface of the combustion chamber.

In the hot water storage boiler, the innermost supply pipe among the plurality of supply pipes may be arranged to face a center of the bottom surface of the combustion chamber, and the outermost supply pipe among the plurality of supply pipes may be arranged to face an outer periphery of bottom surface of the combustion chamber.

In the hot water storage boiler, the spray pipe may include: a supply pipe having a plurality of spray holes provided in a top portion thereof along a longitudinal direction; and an inlet pipe connected to one end or the other end of the supply pipe. Water supplied through the inlet pipe from an external source may pass through the supply pipe and then is sprayed through the spray holes toward the bottom surface of the combustion chamber.

The hot water storage boiler may further include a control unit controlling a flow rate of water supplied to the spray pipe.

The hot water storage boiler may further include a plate-shaped baffle blocking an upper portion and a lower portion of the space from each other, with a guide hole being provided in the baffle. The space may have an upper space portion and a lower space portion divided by the baffle. Water nay enter the lower space portion through the guide hole before being discharged outwards.

In the hot water storage boiler, the plurality of tubes may be radially arranged in the space, the guide hole may be located in a central portion of the baffle, and a plurality of tube passage holes may be provided in the baffle such that the plurality of tubes pass therethrough, the plurality of tube passage holes being radially arranged around the guide hole.

In the hot water storage boiler, the spray pipe may be located above the baffle.

In the hot water storage boiler, an outer circumference of the combustion chamber may be smaller than an inner circumference of the body, such that a guide space portion is provided between the outer circumference of the combustion chamber and the inner circumference of the body, and a spiral guide is provided on the outer circumference of the combustion chamber or the inner circumference of the body. The guide space portion may be configured to circulate on the outer circumference of the combustion chamber along the spiral guide. When water entering the space is converted into hot water by heat exchange with the plurality of tubes, the hot water may be guided into the guide space portion before being discharged from the body.

Advantageous Effects

The present invention is intended to lower the temperature of the bottom portion of the combustion chamber by spraying low-temperature water toward the bottom portion of the combustion chamber using the spray pipe, thereby reducing production of scale.

Since the spray pipe has the plurality of supply pipes, water can be uniformly sprayed to the entire area from the central portion to the peripheral portion of the bottom portion of the combustion chamber, thereby rapidly lowering the temperature of the entire area of the bottom portion of the combustion chamber. This can consequently further reduce production of scale on the bottom portion of the combustion chamber.

In addition, low-temperature water collides into the bottom portion during passage through the guide hole of the baffle, thereby spreading in the upper space portion. This can consequently lower the temperature of the bottom portion, thereby reducing production of scale.

Furthermore, since water flows at a high speed from the lower space portion to the upper space portion through the guide hole of the baffle, the water strongly collides into the bottom portion, thereby preventing scale from being accumulated on the bottom portion.

In addition, since the guide space portion is configured to circulate on the outer circumference of the sidewall portion along the spiral guide, hot water heated in the tubes circulates on the outer circumference of the sidewall portion through the guide space portion. This can increase a time in which hot water is in contact with the sidewall portion, thereby increasing the heat exchange efficiency of the combustion chamber.

DESCRIPTION OF THE REFERENCE NUMERALS IN THE DRAWINGS

| | |
|---|---|
| 1000: Boiler | |
| 100: Body | 110: Housing |
| 112: Space | 112a: Lower space portion |
| 112b: Upper space portion | 114: Lower cover |
| 116: Upper cover | 120: Supply water inlet |
| 130: Hot water outlet | 140: Spray water supply |
| 200: Combustion chamber | 210: Bottom portion |
| 220: Sidewall portion | 222: Spiral guide |
| 230: spiral guide | 300: Burner |
| 310: air supply | 400: Tube |
| 500: Spray pipe | 510: Supply pipe |
| 520: Connector pipe | 525: Spray hole |
| 530: Inlet pipe | 600: Baffle |
| 602: Guide hole | 604: Tube passage hole |
| 700: Exhaust unit | 710: Exhaust pipe |

BEST MODE

Hereinafter, a hot water storage boiler having a scale prevention function according to an exemplary embodiment of the present invention will be described in more detail with reference to the accompanying drawings.

Figure 1:
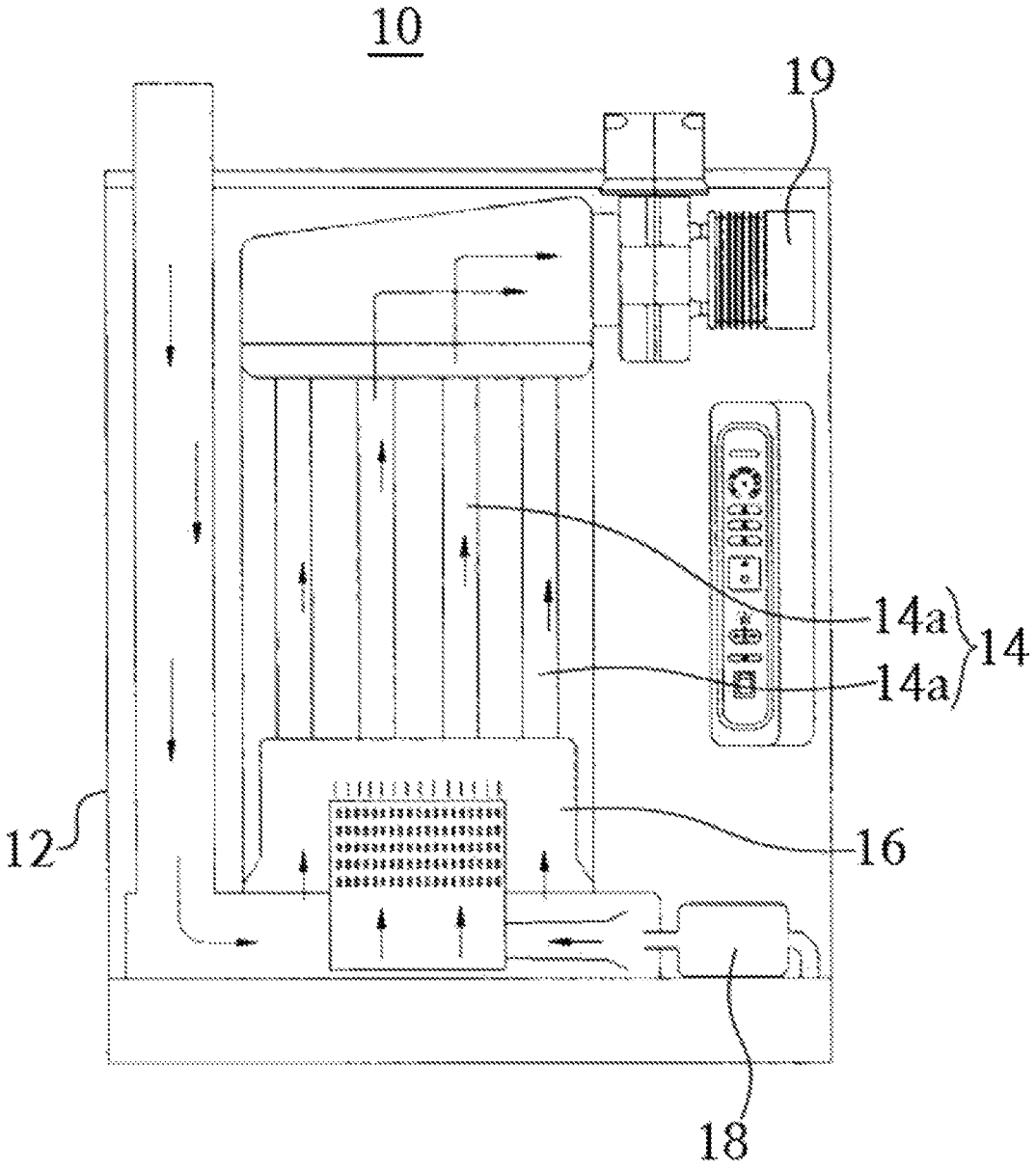
FIG. 1 illustrates a hot water storage boiler of the related art.
Figure 2:
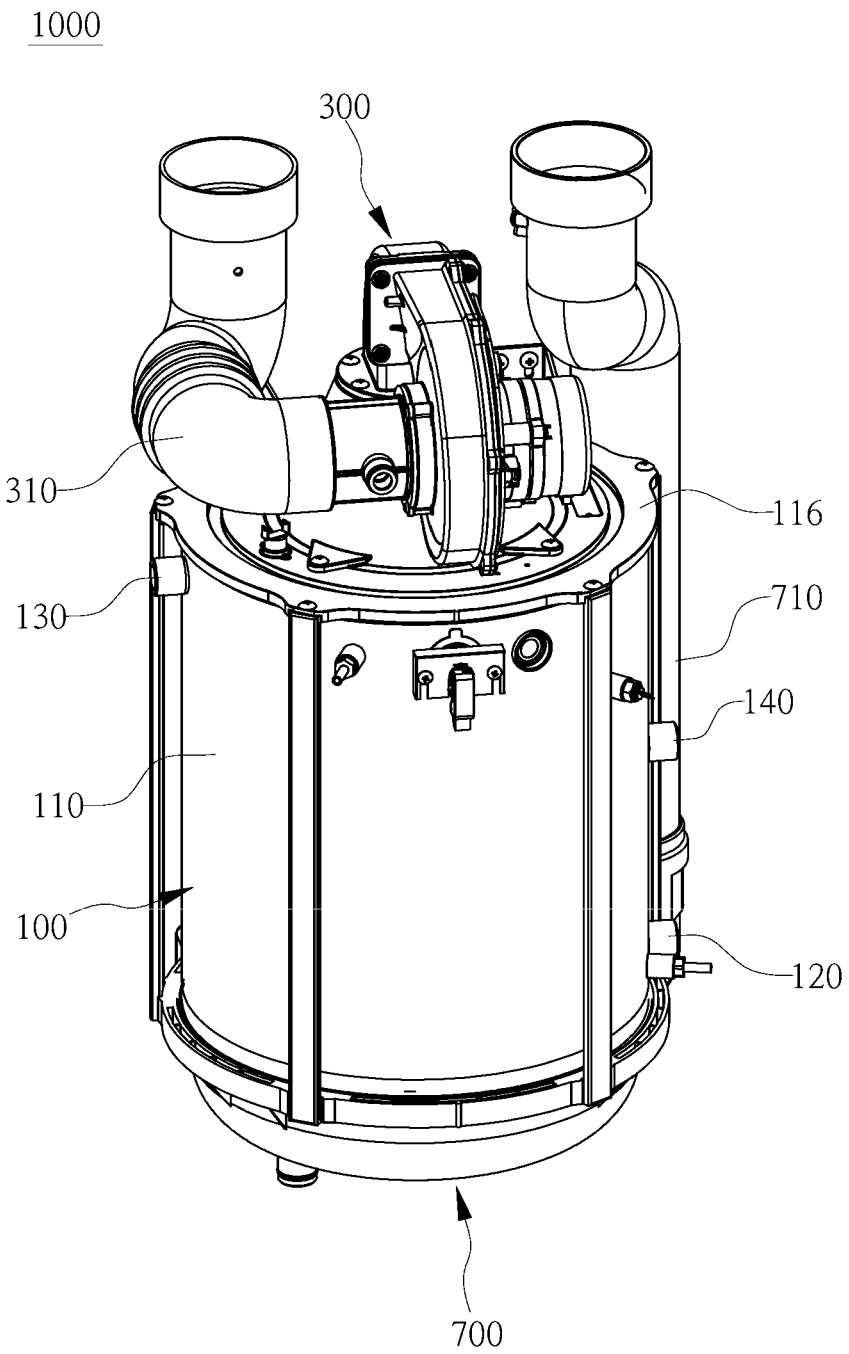
FIG. 2 illustrates a hot water storage boiler having a scale prevention function according to an exemplary embodiment of the present invention.
Figure 3:
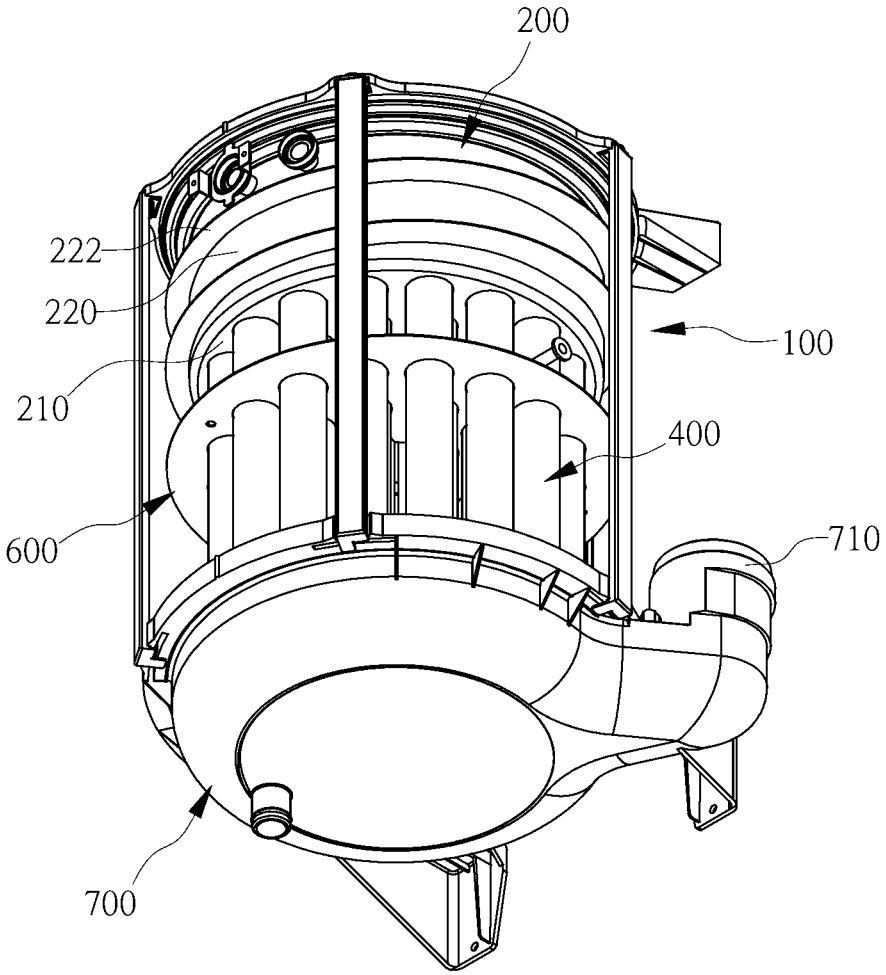
FIG. 3 schematically illustrates the interior of a body of the hot water storage boiler having a scale prevention function according to the exemplary embodiment of the present invention.

FIG. 2 illustrates a hot water storage boiler having a scale prevention function according to an exemplary embodiment of the present invention, and FIG. 3 schematically illustrates the interior of a body of the hot water storage boiler having a scale prevention function according to the exemplary embodiment of the present invention.

Referring to FIGS. 2 and 3, the hot water storage boiler 1000 having a scale prevention function according to the exemplary embodiment of the present invention includes a body 100, a combustion chamber 200, a burner 300, a bundle of tubes 400, a spray pipe 500, a baffle 600, and an exhaust unit 700.

The body 100 includes a substantially-cylindrical housing 110 having defined a hollow space 112 (see FIG. 7) therein, a bottom cover 114 closing an open bottom portion of the housing 110, and a top cover 116 closing an open top portion of the housing 110. A supply water inlet 120 is provided on a side portion of the bottom portion of the housing 110, allowing water to be supplied into the housing 110, and a hot water outlet 130 is provided on a side portion of the top portion of the housing 110. Supply water is supplied into the housing 110 through the supply water inlet 120 to be heated while flowing through the tubes 400, which will be described later. Hot water produced through the heating of the supply water is discharged through the hot water outlet 130. The hot water, discharged from the body 100, is used as bath water, heating water, or the like.

The shape of the combustion chamber 200 is substantially cylindrical, and is provided in the upper portion of the inside of the housing 110 such that an independent space is defined therein. The combustion chamber 200 includes a bottom portion 210 provided in the bottom and a sidewall portion 220 protruding vertically upward along the periphery of the bottom portion 210. The outer circumference of the sidewall portion 220 is configured to be smaller than the inner circumference of the housing 110, such that a hollow space, i.e. a guide space portion 230 (see FIG. 7), is provided between the outer circumference of the sidewall portion 220 and the inner circumference of the housing 110. When the supply water, introduced into the housing 110, is converted into hot water by being heated in the tubes 400, the hot water is guided through the guide space portion 230 before being discharged from the housing 110. A spiral guide 222 is provided between the outer circumference of the sidewall portion 220 and the inner circumference of the housing 110, such that the guide space portion 230 is configured to circulate on the outer circumference of the sidewall portion 220 along the spiral guide 222. Since the guide space portion 230 is configured to circulate on the outer circumference of the sidewall portion 220 along the spiral guide 222, hot water heated in the tubes 400 circulates on the outer circumference of the sidewall portion 220 along the guide space portion 230. This configuration can increase a time in which hot water is in contact with the sidewall portion 220, thereby increasing the heat exchange efficiency of the combustion chamber 200.

The burner 300 is mounted on the top surface of the top cover 116 to project a flame into the combustion chamber 200. The burner 300 has a typical configuration for properly mixing fuel, such as gas, with air and burning the mixture to produce a flame. When the burner 300 projects the flame into the sidewall portion 220, hot combustion gas is produced by the flame. The burner 300 has an air supply 310 for supplying ambient air to the burner 300.

Each of the tubes 400 has the shape of a hollow cylinder. Each of the tubes 400 is connected to the bottom portion 210 with one end thereof penetrating into the bottom portion 210, and is connected to the bottom cover 114 with the other end thereof penetrating into the bottom cover 114. The bundle of tubes 400, comprised of a plurality of tubes, may be radially arranged within the housing 110. When hot combustion gas, produced within the combustion chamber 200, flows into the tubes 400, the tubes 400 are heated to a high temperature by the heat of the combustion gas. After passing through the tubes 400, the combustion gas is exhausted through the exhaust unit 700.

The exhaust unit 700 is disposed on the bottom surface of the bottom cover 114 in order to let combustion gas, exhaust gas, or the like, discharged from the tubes 400, to exit. The exhaust gas is discharged through an exhaust pipe 710.

Figure 4:
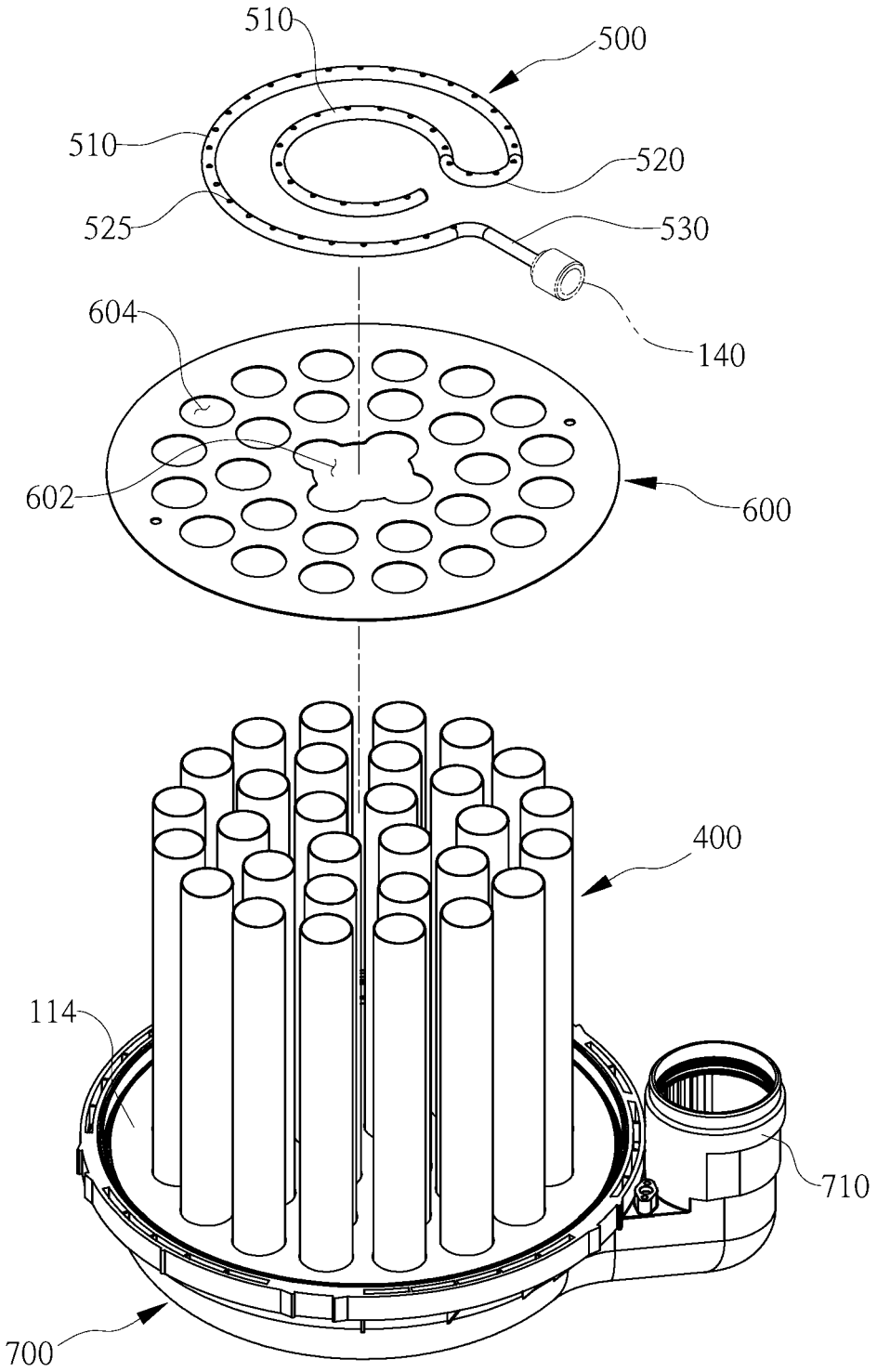
FIG. 4 schematically illustrates the hot water storage boiler having a scale prevention function according to the exemplary embodiment of the present invention, in which the baffle and the spray pipe are separated from the boiler.
Figure 5:
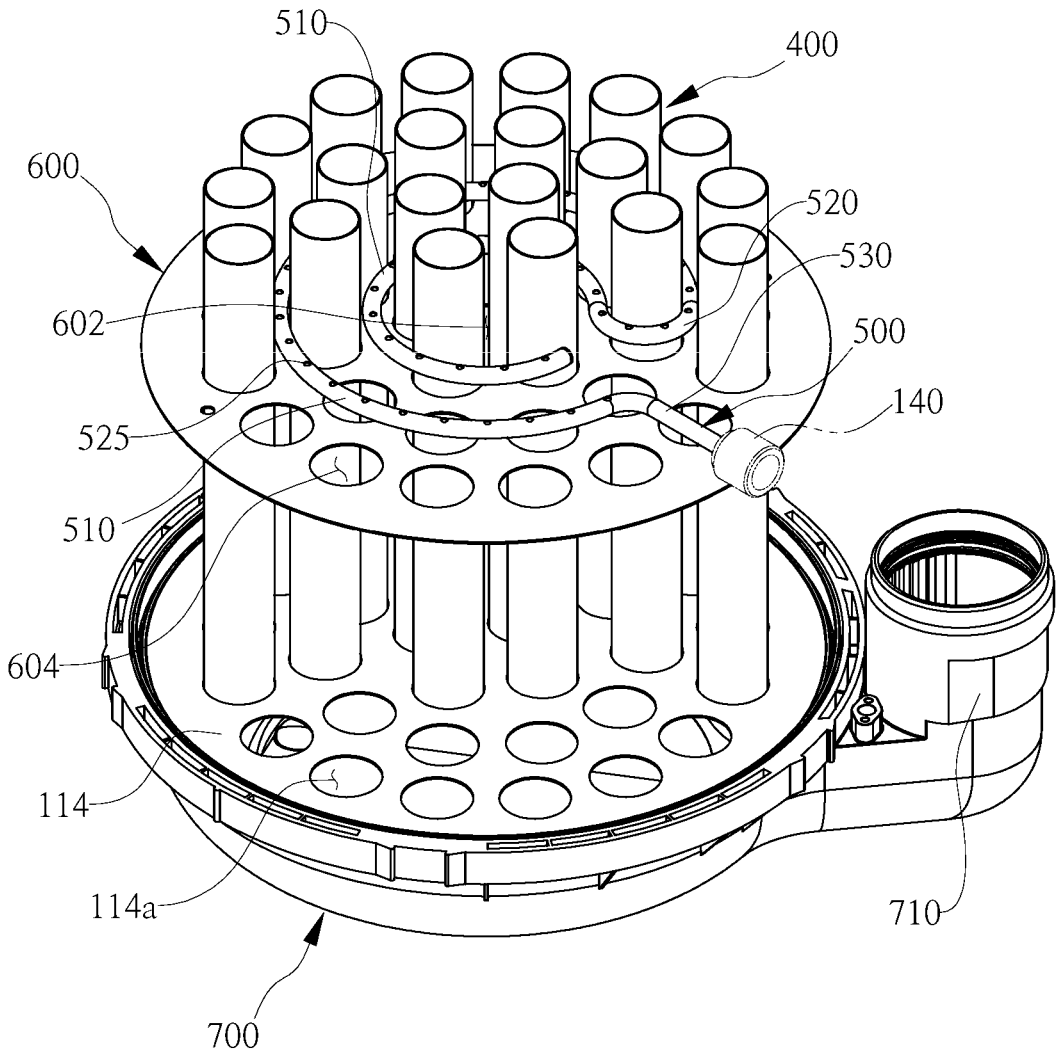
FIG. 5 schematically illustrates the hot water storage boiler having a scale prevention function according to the exemplary embodiment of the present invention, in which the baffle and the spray pipe are attached to the boiler.
Figure 6:
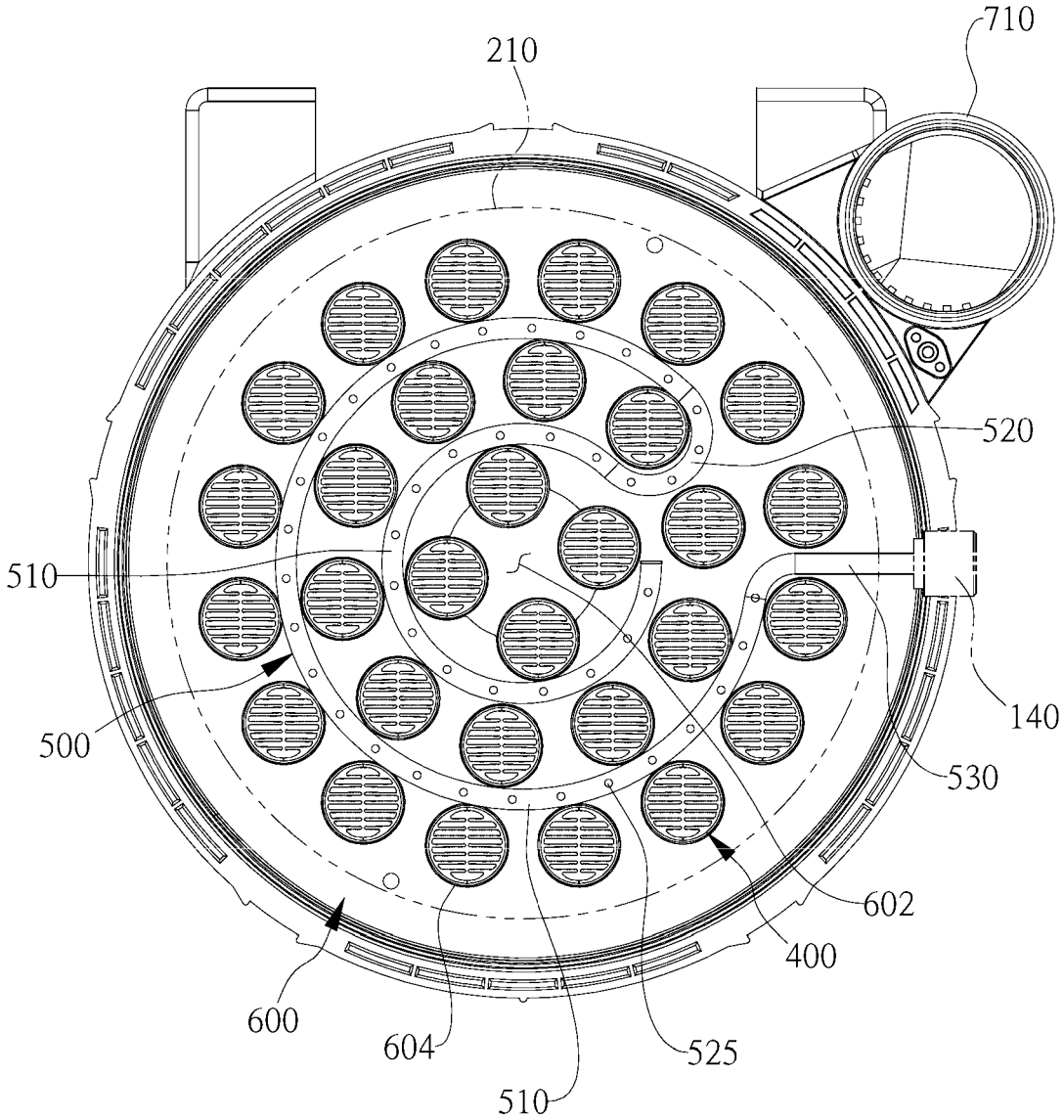
FIG. 6 is a top plan view illustrating the hot water storage boiler having a scale prevention function according to the exemplary embodiment of the present invention, in which the baffle and the spray pipe are attached to the boiler.

FIG. 4 schematically illustrates the hot water storage boiler having a scale prevention function according to the exemplary embodiment of the present invention, in which the baffle and the spray pipe are separated from the boiler, FIG. 5 schematically illustrates the hot water storage boiler having a scale prevention function according to the exemplary embodiment of the present invention, in which the baffle and the spray pipe are attached to the boiler, and FIG. 6 is a top plan view illustrating the hot water storage boiler having a scale prevention function according to the exemplary embodiment of the present invention, in which the baffle and the spray pipe are attached to the boiler.

Referring to FIGS. 4 to 6, the bottom portion 210 of the combustion chamber 200 is connected to the burner 300. Due to this configuration, the bottom portion 210 of the combustion chamber 200 remains hot, with the temperature being gradually lowered in the direction toward the bottom cover 114. Due to the property of calcium in water tending to produce more scale at a higher temperature, scale is easily produced by calcium on the hot bottom cover 114. To remove this problem, the present invention lowers the temperature of the bottom portion 210 of the combustion chamber 200 using the baffle 600 and the spray pipe 500 in order to effectively reduce the production of scale.

The baffle 600 is located, for example, in the longitudinal central portion within the housing 110 to block the upper portion and the lower portion of the space 112 of the housing 110 from each other. Consequently, the space 112 has an upper space portion 112*b* and a lower space portion 112*a* divided by the baffle 600. Specifically, the upper space portion 112*b* is located above the baffle 600, while the lower space portion 112*a* is located below the baffle 600. A guide hole 602 is provided in the baffle 600. The guide hole 602 may be provided in the central portion of the baffle 600. In addition, the baffle 600 has a plurality of tube passage holes 604 in positions corresponding to the tubes 400, such that the tubes 400 pass through the tube passage holes 604. The plurality of tube passage holes 604 may be radially arranged around the guide hole 602. The guide hole 602 may be provided with a filter (not shown) to remove a variety of impurities contained in water.

Since the lower space portion 112*a* is farther away from the burner 300 than the upper space portion 112*b*, the temperature of water in the lower space portion 112*a* is lower than the temperature of water in the upper space portion 112*b*. The low-temperature water in the lower space portion 112*a* collides into the bottom portion 210 while passing through the guide hole 602, thereby spreading in the upper space portion 112*b*. This can consequently lower the temperature of the bottom portion 210, thereby reducing production of scale.

The spray pipe 500 is located above the baffle 600 to face the bottom portion 210 of the combustion chamber 200, and is configured to spray water in the direction of the bottom portion 210. The spray pipe 500 includes a plurality of C-shaped concentric supply pipes 510 having different radii, a connector pipe 520 connecting ends of a pair of adjacent supply pipes 510 among the plurality of supply pipes 510, except for one end of the outermost supply pipe 510 and one end of the innermost supply pipe 510, and an inlet pipe 530 connected to one end of the outermost supply pipe 510 or the innermost supply pipe 510 among the plurality of supply pipes 510. Both ends of the supply pipes 510 are located adjacently to each other while facing each other. The connector pipe 520 is configured to connect the facing ends of the pair of supply pipes 510. When the supply pipes 510 are three or more supply pipes, a plurality of connector pipes 520 is provided to alternately connect one end of each of the plurality of supply pipes 510 to the other end of the corresponding one of the plurality of supply pipes 510.

In addition, a plurality of spray holes 525 is provided in the top portions of the supply pipes 510 and the connector pipe 520 along the longitudinal direction. Since the inlet pipe 530 is connected to a spray water supply 140, water introduced into the inlet pipe 530 through the spray water supply 140 from an external source is supplied to the supply pipes 510 and the connector pipe 520 before being sprayed toward the bottom portion 210 of the combustion chamber 200 through the spray holes 525. Since the spray pipe 500 sprays low-temperature water toward the bottom portion 210 of the combustion chamber 200 as described above, the temperature of the bottom portion 210 of the combustion chamber 200 may be lowered, thereby reducing production of scale.

In addition, the innermost supply pipe 510 among the plurality of supply pipes 510 is arranged to face the center of the bottom portion 210 of the combustion chamber 200, while the outermost supply pipe 510 among the plurality of supply pipes 510 is arranged to face the outer periphery of bottom portion 210 of the combustion chamber 200. Since the plurality of supply pipes 510 is provided as described above, the supply pipes 510 can uniformly spray supply water over the entire area from the center to the outer periphery, thereby rapidly lowering the temperature of the entire area of the bottom portion 210 of the combustion chamber 200. This can further reduce production of scale in the bottom portion 210 of the combustion chamber 200.

In addition, the spray water supply 140 may further include a control unit (not shown) controlling the flow rate of water entering the inlet pipe 530. The control unit may have a typical configuration of controlling the amount of water supplied, including a flow rate control valve, a motor, a controller, and the like.

In some cases, the spray pipe 500 may be configured to be spirally wound. In this case, the spray pipe 500 includes a supply pipe having a plurality of spray holes provided in the top portion thereof along the longitudinal direction and an inlet pipe connected to one end or the other end of the supply pipe. Water supplied through the inlet pipe from an external source passes through the supply pipe and then is sprayed through the spray holes toward the bottom portion 210 of the combustion chamber 200.

Figure 7:
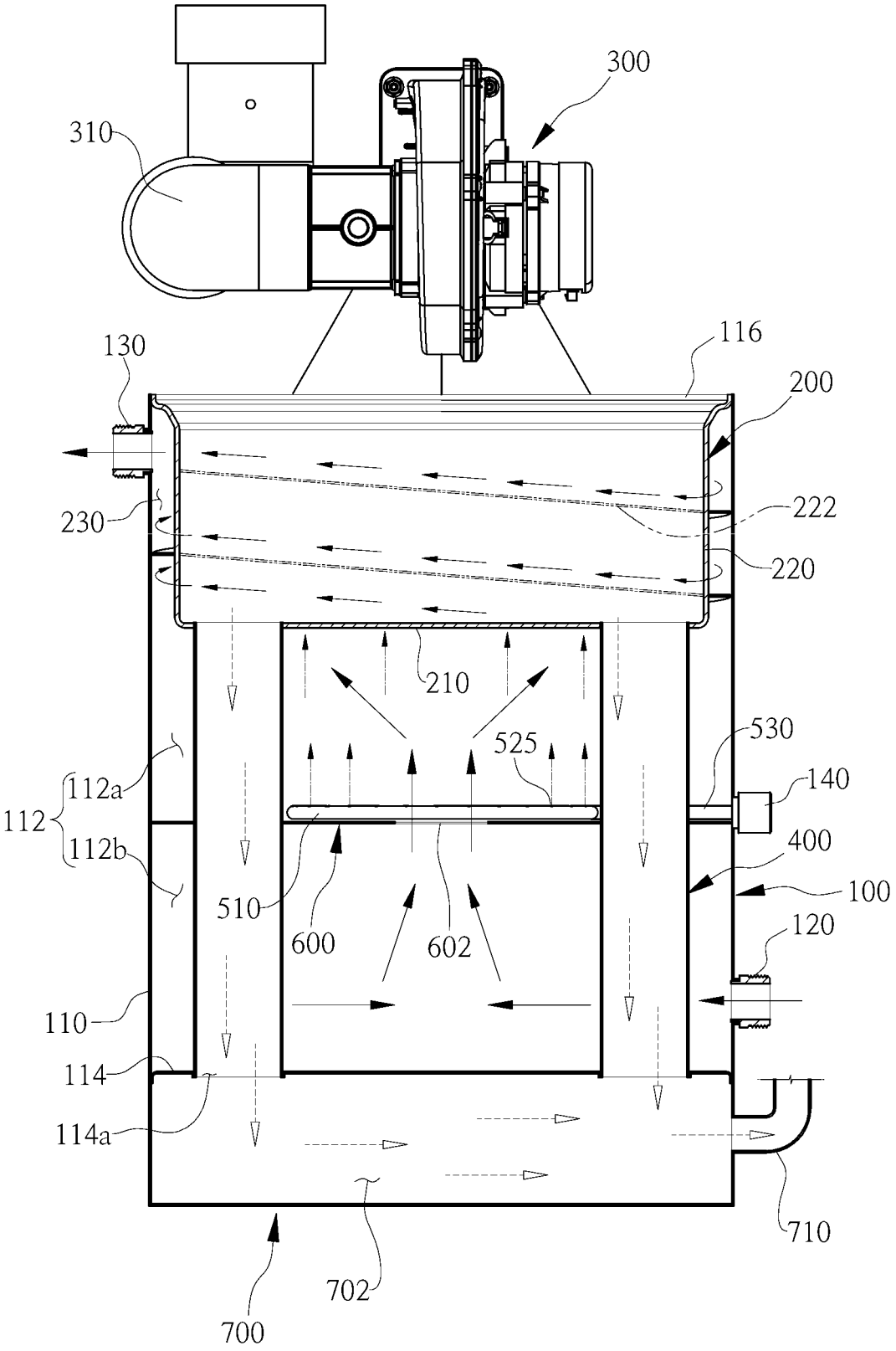
FIG. 7 schematically illustrates the hot water storage boiler having a scale prevention function according to the exemplary embodiment of the present invention, such that flows of combustion gas and water in the boiler are represented.

FIG. 7 schematically illustrates the hot water storage boiler having a scale prevention function according to the exemplary embodiment of the present invention, such that flows of combustion gas and water in the boiler are represented.

Referring to the drawing, when the burner 300 is ignited, a flame is projected into the combustion chamber 200, thereby producing hot combustion gas within the combustion chamber 200. The combustion gas heats the combustion chamber 200, flows through the plurality of tubes 400 to heat the tubes 400, and then is discharged through the exhaust unit 700.

After being supplied to the lower space portion 112*a* within the housing 110 through the supply water inlet 120, water is heated by the tubes 400. Afterwards, water is supplied to the upper space portion 112*b* at a fast flow rate, which is increased during passage through the guide hole 602 of the baffle 600, before colliding into the bottom portion 210 of the combustion chamber 200. When water entering the lower space portion 112*a* passes through the guide hole 602, i.e. a narrower space, from the lower space portion 112*a*, i.e. a wider space, the velocity of the water is increased. Consequently, water, the velocity of which is increased during flowing from the lower space portion 112*a* to the upper space portion 112*b*, collides into the bottom portion 210 at a high speed and then moves to the guide space portion 230, so that no scale is accumulated in the bottom portion 210.

In addition, after passing through bottom portion 210, water circulates on the outer circumference of the combustion chamber 200 along the guide space portion 230, during which process water is converted into hot water by heat exchange. Hot water, produced as described above, is discharged through the hot water outlet 130.

The invention claimed is:

1. A hot water storage boiler comprising:

a body having defined a space therein, to which water is supplied, the body comprising a combustion chamber provided in an upper portion of the space;

a burner projecting a flame into the combustion chamber;

a plurality of tubes located within the space, with top ends thereof being integrally connected to a bottom surface of the combustion chamber and bottom ends thereof extending to a bottom portion of the space;

an exhaust unit provided on a bottom of the body and integrally connected to the bottom ends of the tubes; and a spray pipe disposed within the body to face the bottom surface of the combustion chamber, with a plurality of spray holes thereof being provided in a direction of the bottom surface of the combustion chamber, wherein water supplied to the spray pipe is sprayed through the plurality of spray holes toward the bottom surface of the combustion chamber, wherein the spray pipe comprises:

a plurality of C-shaped concentric supply pipes having different radii;

a connector pipe connecting ends of a pair of adjacent supply pipes among the plurality of supply pipes, except for one end of an outermost supply pipe and one end an innermost supply pipe among the plurality of supply pipes; and an inlet pipe connected to one end of the outermost supply pipe or the innermost supply pipe among the plurality of supply pipes, and the plurality of spray holes is provided in top portions of the supply pipes and the connector pipe along longitudinal directions thereof, and wherein water entering through the inlet pipe is supplied to the plurality of supply pipes and the connector pipe and then is sprayed through the plurality of spray holes toward the bottom surface of the combustion chamber.

2. The hot water storage boiler according to claim 1, wherein the innermost supply pipe among the plurality of supply pipes is arranged to face a center of the bottom surface of the combustion chamber, and the outermost supply pipe among the plurality of supply pipes is arranged to face an outer periphery of bottom surface of the combustion chamber.

3. The hot water storage boiler according to claim 1, wherein the spray pipe comprises:

a supply pipe having a plurality of spray holes provided in a top portion thereof along a longitudinal direction; and an inlet pipe connected to one end or the other end of the supply pipe, wherein water supplied through the inlet pipe passes through the supply pipe and then is sprayed through the spray holes toward the bottom surface of the combustion chamber.

4. The hot water storage boiler according to claim 1, further comprising a controller configured to control a flow rate of water supplied to the spray pipe.

5. The hot water storage boiler according to claim 1, further comprising a plate-shaped baffle blocking an upper portion and a lower portion of the space from each other, with a guide hole being provided in the baffle, wherein the upper space portion and the lower space portion are divided by the baffle, wherein water enters into the lower space portion through the guide hole before being discharged outwards.

6. The hot water storage boiler according to claim 5, wherein the plurality of tubes is radially arranged in the space, the guide hole is located in a central portion of the baffle, and a plurality of tube passage holes are provided in the baffle such that the plurality of tubes pass therethrough, the plurality of tube passage holes being radially arranged around the guide hole.

7. The hot water storage boiler according to claim 6, wherein the spray pipe is located above the baffle.

8. The hot water storage boiler according to claim 1, wherein an outer circumference of the combustion chamber is smaller than an inner circumference of the body, such that a guide space portion is provided between the outer circumference of the combustion chamber and the inner circumference of the body, and a spiral guide is provided on the outer circumference of the combustion chamber or the inner circumference of the body, and the guide space portion is positioned around the outer circumference of the combustion chamber along with the spiral guide, wherein, when water entering the space is converted into hot water by heat exchange with the plurality of tubes, the hot water is guided into the guide space portion before being discharged from the body.

* * * * *